United States Patent [19]

Shibayama et al.

[11] 4,058,444

[45] Nov. 15, 1977

[54] PROCESS FOR PREPARING AN INSULATED PRODUCT

[75] Inventors: Kyoichi Shibayama; Fumihiko Satho; Mamoru Naitho, all of Amagasaki, Japan

[73] Assignee: Mitsubishi Denki Kabushiki Kaisha, Tokyo, Japan

[21] Appl. No.: 669,625

[22] Filed: Mar. 23, 1976

[30] Foreign Application Priority Data

| | | |
|---|---|---|
| Mar. 31, 1975 | Japan | 50-39435 |
| Mar. 31, 1975 | Japan | 50-39436 |

[51] Int. Cl.[2] ..... C25D 13/06; C25D 13/10

[52] U.S. Cl. ..... 204/181

[58] Field of Search ..... 204/181

[56] References Cited

U.S. PATENT DOCUMENTS

| | | | |
|---|---|---|---|
| 2,707,703 | 5/1955 | Dorst | 204/181 |
| 3,093,511 | 6/1963 | Weisel et al. | 204/181 |

*Primary Examiner*—Howard S. Williams

*Attorney, Agent, or Firm*—Oblon, Fisher, Spivak, McClelland & Maier

[57] ABSTRACT

A process for preparing an insulated product comprises forming an electrodeposited layer having high inorganic powder content by dipping a substrate in an electrodeposition varnish prepared by admixing an inorganic powder with a water dispersion varnish and electrodepositing the inorganic powder, and impregnating an organic or inorganic insulation varnish into the spaces of the electrodeposited layer.

8 Claims, No Drawings

PROCESS FOR PREPARING AN INSULATED PRODUCT

BACKGROUND OF THE INVENTION

1. Field of the Invention

The present invention relates to a process for preparing insulated products, such as coils for rotary machines.

2. Description of the Prior Art

It has been proposed in the past to prepare insulated products by covering a conductive material with an organic or inorganic material such as a tape or sleeve made of woven or non-woven cloth, and then electrodeposition-coating it in a water dispersion varnish.

In this method, the resultant properties of the insulation film are dependent upon the characteristics of the water dispersion varnish used. The heat-resistance, mechanical properties and elctrical insulation capabilities have not been satisfactory, especially at high temperature. Conventionally, a tape-winding operation is required to form the insulation layer whereby many hand operations are needed, the efficiency of operation is low and the cost is been high.

SUMMARY OF THE INVENTION:

Accordingly, it is an object of the present invention to provide a process for preparing an insulated product having an insulation film of improved heat-resistane of, and improved mechanical and electrical characteristics and high reliability of insulation, thereby overcoming the disadvantages of conventional processes of forming insulation layers.

It is another object of this invention to provide a process for insulating coils of rotary machines.

Still another object of this invention is to provide a process for preparing an insulated product by simultaneously insulating bare wires of coils and insulating the coils from the earth.

These objects of the invention have been attained by providing a process comprising a step of forming an electrodeposited layer containing an inorganic material by electrodeposition on a substrate such as a coil in an electrodeposition bath prepared by mixing an inorganic material such as mica with a water dispersion varnish, and a step of impregnating an organic or inorganic insulation varnish into spaces of the electrodeposited layer.

DETAILED DESCRIPTION OF THE PREFERRED EMBODIMENTS

In the first embodiment of the invention, the electrodeposited layer having a high mica content is formed on a coil by electrophoresis with a water dispersion varnish containing mica power. Then, the product is heated and the organic or inorganic insulation varnish is impregnated throughout of the resulting electrodeposited layer so as to form a high strength insulation film in which a mica layer is bonded. Considerations for determining appropriate conditions for the preliminary electrodeposited layer, include the necessity to be able to electrodeposit it in an electrodeposition varnish after heating, and the necessity for it and to have sufficient mechanical strength for treatment in the later step. The properties are mainly dependent upon the mica content in the electrodeposited layer, and also depending upon the thickness of the electrodeposited layer.

When the mica content is less than 80 wt.%, it is necessary to apply remarkably high voltage for further electrodeposition. When the mica content is less than 75 wt.%, it is impossible to conduct further electrodeposition.

The thickness of the electrodeposited layer is determined by the withstand voltage characteristics between the bare wires. It is usually in the range of 80–120 μm, since higher than 2 KV of withstand voltage is required.

Appropriately conditions for the latter electrodeposited layer include the need for the organic or inorganic insulation varnish to be impregnated into the spaces of the electrodeposited layer and between the bare wires. When the mica, content is less than 70 wt.%, the spaces between the mica powder locations are as small that it is difficult to impregnate the organic or inorganic insulation varnish.

On the other hand, when the mica content is higher than 99%, the mechanical strength of the preliminarily electrodeposited layer is too weak. Accordingly, the mica content of an insulation layer to ground is preferably in the range of 75–98%.

The suitable size of the mica powder in the electrodeposited layer for an insulation part between bare wires and the insulation part to ground, is dependent upon the desired mechanical strength of the electrodeposited layer, the immersion properties of the insulation varnish and the electrodepositablility.

When the size of the mica powder is larger than a certain range (larger than 20 mesh), the electrodeposited mica powder causes electrical interruption whereby desirable thichnesses are not produced.

Accordingly, mica powder having a size smaller than 20 mesh is preferably used. The voltage for electrodeposition, is usually in the range of 10 to 100 volts in the preliminary electrodeposition (before bundling), and is usually in the range of 50–300 volts in the secondary electrodeposition (after bundling). The latter is remarkably higher than the voltage in the preliminary electrodeposition because the preliminary electrodeposited layer forms an electrical interruption layer, preventing electrophoresis of the mica powder under low voltage.

In the conventional method of insulating by electrodeposition with only a water dispersion varnish, the various characteristics of the insulation layer are dependent upon the water dispersion varnish used for the electrodeposition.

Accordingly, a varnish which imparts desirable characteristics has been needed. However, water dispersion varnish which imparts desirably high heat resistance which can be applied for insulating an armature coil does not exist.

In the process of this invention, the characteristics of the insulation film are dependent upon the type of insulation varnish used for impregnating it. An insulation film having excellent characteristics can be easily formed by selecting the insulation varnish according to the desired properties. In the process of this invention, a tape winding operation is not needed for the formation of an insulation layer whereby productivity is highly improved.

Moreover, in the conventional processes an organic solvent is required as a film forming auxiliary agent in the formation of the film.

However, in the process of this invention, mica powder is principally used for electrical insulation.

Accordingly, it is unnecessary to use an organic solvent whereby the extra required for the step curing operation can be eliminated and the time required for drying can be shortened to about 1/10–1/5 times that of the conventional process.

Mica powder is used as the inorganic material in the electrodeposition baths used for preparing coils of rotary machines, heat-resistant wires and flame-resistant wires because of considerations of mechanical strength and calcination. However, in the case of coils of rotary machines and shaped insulators which need not be flexible, it is possible to use other inorganic powders or mixtures of mica powder and other inorganic powders.

Typical inorganic powders include chips of glass fiber, glass powder, silica powder, alumina powder and the like.

Suitable water dispersion varnishes for use in the process of this invention as the electrodeposition varnish include polyurethane resin varnish, polyester resin varnish, epoxy resin varnish, epoxy ester resin varnish, polyimide resin varnish, polyamideimide resin varnish, polyester imide resin varnish, acryl resin varnish and the like.

Suitable organic insulation varnishes for use as the insulation varnish for impregnating into the electrodeposition layer, include high heat-resistant epoxy resin varnish, polyamideimide resin varnish, silicone resin varnish, polyimide resin varnish and the like. Suitable inorganic insulation varnishes to be used for impregnation include phosphoric acid-containing varnish, silica-containing varnish and the like.

Since it is necessary to have sufficient immersion properties, the viscosity of the insulation varnish used for impregnation is usually lower than about 1000 cp and is preferably in the range of 50–800 cp.

Suitable substances to be coated by electrodeposition include any conductive materials having various shapes such as linear shapes, rod shapes and plate shapes.

In a second embodiment of this invention, an inorganic or organic fibrous material such as glass fiber cloth, polyester non-woven fabric, polyester woven fabric and the like is used to cover the substrate of conductive material. For example, a plurality of wires each of which is covered with an inorganic or organic non-woven or woven fabric is bundled to form associated coils or bundled wires, and is further covered with the inorganic or organic non-woven or woven fabric material. Thereafter, an electrodeposition coating is applied in a water dispersion varnish containing mica powder and then the inorganic or organic insulation varnish is impregnated into the spaces of the electrodeposited layer and the spaces of the inorganic or organic fibrous material, whereby the fibrous material and the mica layer formed by the electrodeposition are bonded to form an insulation film having high strength.

The impregnation of the organic or inorganic insulation varnish into the electrodeposited layer and the spaces of the fibrous material in order to bond them so as to form an insulation structure is dependent upon the nature of the electrodeposited layer, especially the ratio of the mica powder content to the resin content.

When the resin content is higher than 30 wt.%, the spaces of the electrodeposited layer are not sufficient to satisfactorily impregnate the insulation varnish.

As a result, spaces remain in the inorganic or organic fibrous material creating an undesirable condition as an insulation structure. On the other hand, when the resin component is less than 1 wt.%, the mechanical strength of the electrodeposited layer is too weak. Accordingly, it is necessary to account for this weakness in the treatment in the second step.

From the viewpoints of the immersion property and workability, the resin content of the electrodeposited layer is usually selected from the range of 2–25 wt.%.

The parameters of the electrodeposited layer are also dependent upon the size of the mica powder which is electrodeposited.

When the size of the mica powder is larger than a certain range (smaller than 20 mesh), the electrodeposited mica powder causes electrical interruption whereby a desirable thicknesses are not produced because further electrodeposition is prevented. Moreover, the surface of the electrodeposited layer is not smooth whereby a desirable electrodeposited layer is not produced. Suitable insulation varnishes include the above-mentioned insulation varnishes.

The mica powder can be also substituted by other inorganic powder as stated above.

The electrodeposition of the insulation varnish can also be conducted as stated above.

In accordance with the process of the first embodiment of this invention, an electrodeposited layer having high mica content is formed on the substrate. If preferred, an electrodeposited layer having high mica content is also formed on a plurality of bundled electrodeposited products. Thereafter, the insulation varnish is impregnated into the electrodeposited layer whereby an insulated product having an electrodeposited insulation film which has excellent thermal, mechanical and electrical characteristics and which has the desired thickness can be prepared in high productivity. In accordance with the process of the second embodiment of this invention, an electrodeposited layer having high mica content is formed on inorganic or organic fibrous material covered on the substrate and then the insulation varnish is impregnated into the electrodeposited layer whereby an insulation product having an electrodeposited insulation film which has excellent thermal, mechanical and electrical characteristics and which has a desired thickness can be prepared in high productivity.

The invention will be further illustrated by certain examples wherein the terms "part" and "percent" mean "parts by weight" and "percent by weight", respectively. The following are examples for the first embodiment.

EXAMPLE 1:

A mica powder which was passed through 100 mesh sieve and was washed with water, was admixed with a water dispersion acrylic epoxy resin varnish (V-550-20 varnish manufactured by Ryoden Kasei K. K.) at a ratio of 9 parts of the mica powder to 1 part of the resin component, and the mixture was stirred to prepare an uniformly dispersed electrodeposition varnish.

An armature coil for rotary machine as an anode and a stainless steel plate as a cathode were dipped in the electrodeposition varnish with 15 cm of a gap between the anode and the cathode, and 50 volts of DC voltage was applied for 8 seconds to electrodeposit the mica layer on the armature coil. The electrodeposited product was taken out from the electrodeposition varnish and was heated at 230° C for 15 minutes to form the film having 0.10 mm of a thickness.

Six of the electrodeposited coils were bundled and dipped in the same electrodeposition varnish with 15 cm of the gap, and 150 volts of DC voltage were applied for 10 seconds to form the mica layer on the substrate of coils by electrophoresis.

The electrodeposited product was taken out from the electrodeposition varnish and was heated at 230° C for 30 minutes. The electrodeposited product was dipped into an epoxy resin varnish (V-590-15 varnish manufactured by Ryoden Kasei K. K.) under a reduced pressure for 1 hour. The product was taken out and heated at 150° C for 15 hours to form an electrodeposited insulation film having 0.45 mm of an uniform thickness. The withstand voltage of the electrodeposited insulation film between the coils was 9.5 KV and the withstand voltage to the earth was higher than 23 KV.

EXAMPLE 2:

A mica powder which had particle size of 48–80 mesh and was washed with water was admixed with the water dispersion varnish of Example 1 at a ratio of 9 parts of the mica powder to 1 part of the resin component, and the mixture was diluted with a pure water with stirring to prepare an electrodeposition varnish having 13% of total nonvolatile matter which was uniformly dispersed.

The armature coil for rotary machine as an anode and a stainless steel plate as a cathode were dipped in the electrodeposition varnish with 15 cm of a gap between the anode and that cathode, and then 70 volts of DC voltage was applied for 15 seconds to electrodeposite the mica layer on the coil. The electrodeposited product was heated at 230° C for 15 minutes to form a film having 0.08 mm of a thickness. Four of the electrodeposited coils were bundled and dipped in the same electrodeposition varnish with 15 cm of the gap, and 100 volts of DC voltage was applied for 55 seconds to form the mica layer on the substrate of coils.

The electrodeposited product was heated and then was dipped into a polyamideimide resin (HI-400 manufactured by Hitachi Kasei K. K.), and the product was taken up and heated to form an electrodeposited insulation film having 1 mm of an uniform thickness.

The withstand voltage of the electrodeposited insulation film between the coils was 9 KV and the withstand voltage to the earth was higher than 50 KV.

EXAMPLE 3

A mica powder which was passed through 100 mesh sieve and was washed with water, was admixed with a water dispersion varnish containing main components of 77 parts of bisphenol type epoxy resin, 3 parts of ethyleneglycol and 20 parts of tetrahydrophthalic anhydride at a ratio of 9 parts of the mica powder to 1 part of the resin components and the mixture was diluted with a pure water with stirring to prepare an electrodeposition varnish having 15% of total nonvolatile matter which was uniformly dispersed.

The armature coil for rotary machine as an anode and a stainless steel plate as a cathode were dipped in the electrodeposition varnish with 15 cm of a gap between the anode and the cathode, and then 20 volts of DC voltage was applied for 25 seconds to electrodeposite the mica layer on the coil. The electrodeposited product was heated at 230° C for 15 seconds to form a film having 0.11 mm of a thickness.

Six of the electrodeposited coils were bundled and dipped in the same electrodeposition varnish with 15 cm of the gap and 200 volts of DC voltage was applied for 60 seconds to form the mica layer on the substrate. The electrodeposited product was heated and dipped into a polyimide resin varnish (Norimide 102 varnish manufactured by Nippon Rhodia K. K.) and was taken out and heated to form an electrodeposited insulation film having about 3 mm of an uniform thickness.

The withstand voltage of the electrodeposited insulation film between coils was 8 KV and the withstand voltage to the earth was higher than 80 KV.

EXAMPLE 4:

A mica powder which was passed through 100 mesh sieve and washed with water was admixed with a water dispersion acryl resin varnish (Lecton RK-6308 manufactured by E. I. DuPont) at a ratio of 9 parts of the mica powder to 1 part of the resin component and the mixture was stirred to prepare an uniformly dispersed electrodeposition varnish having 30% of nonvolatile matter.

An armature coil for rotary machine as an anode and a stainless steel plate as a cathode were dipped in the electrodeposition varnish with 15 cm of a gap between the anode and the cathode, and 50 volts of DC voltage was applied for 9 seconds to electrodeposite the mica layer on the armature coil. The electrodeposited product was heated at 230° C for 15 minutes to form a film having 0.1 mm of a thickness.

Six of the electrodeposited coils were bundled and dipped in the same electrodeposition varnish with 15 cm of the gap and 300 volts of DC voltage was applied for 25 seconds to form the mica layer on the substrate. The electrodeposited product was heated and dipped into an epoxy resin (V-590-15 varnish manufactured by Ryoden Kagaku K. K.) and the product was heated to form an electrodeposited insulation film having about 2 mm of an uniform thickness.

The withstand voltage of the electrodeposited insulation film between the coils was 10 KV and the withstand voltage to the earth was higher than 65 KV.

EXAMPLE 5

The armature coil for rotary machine was dipped in the electrodeposition bath of Example 1 with 15 cm of the gap and 100 volts of DC voltage was applied for 4 seconds to form the mica layer on the coil.

The electrodeposited product was heated at 230° C for 15 minutes to form a film having 0.1 mm of a thickness.

Four of the electrodeposited coils were bundled and dipped in the same electrodeposition varnish with 15 cm of the gap and 150 volts of DC voltage was applied for 45 seconds to form the mica layer on the substrate.

The electrodeposited product was heated and was dipped into Tec Coat varnish (manufactured by Nippon Thermo Tec K. K.), and was taken out and heated to form an electrodeposited insulation film having about 2 mm of an uniform thickness.

The withstand voltage of the electrodeposited insulation film between the coils was 8 KV and the withstand voltage to the earth was higher than 60 KV. When the other water dispersion varnishes such as polyurethane resin varnish, polyester resin varnish and polyimide resin varnish were used instead of the insulation varnish, in said Examples 1 to 5, the similar characteristics were given.

The following are examples for the second embodiment.

EXAMPLE 6

A mica powder which was passed through 100 mesh sieve and washed with water and, was admixed with a water dispersion varnish containing main components of 77 parts of bisphenol type epoxy resin, 3 parts of ethyleneglycol and 20 parts of tetrahydrophthalic anhydride at a ratio of 9 parts of the mica powder to 1 part of the resin components to prepare an uniformly dspersed electrodeposition varnish.

A polyester nonwoven fabric tape having 0.05 mm of a thickness and 19 mm of a width was wounded around an armature coil for rotary machine under partially overlapping.

Four of the wounded armature coils were bundled and wounded by the polyester nonwoven fabric tape under partially overlapping.

The bundled product as an anode and a stainless steel plate as a cathode were dipped into the electrodeposition varnish with 15 cm of a gap and 150 volts of DC voltage was applied for 15 seconds to electrodeposite the mica layer on the polyester nonwoven fabric tape by electrophoresis. The electrodeposited product was taken out from the electrodeposition varnish and was heated at 230° C for 20 minutes and then was dipped into an epoxy resin varnish (V-590-15 varnish manufactured by Ryoden Kasei K. K.) under a reduced pressure for 1 hour.

The product was taken out and heated at 150° C for 15 hours to form an electrodeposited insulation film having 0.5 mm of an uniform thickness. The withstand voltage of the electrodeposited insulation film between the coils was 7 KV and the withstand voltage to the earth was higher than 25 KV.

EXAMPLE 7

A mica powder which has particle size of 48 -80 mesh and was washed with water was admixed with the water dispersion varnish of Example 6 at a ratio of 9 parts of the mica powder to 1 part of the resin component, and the mixture was diluted with a pure water with stirring to prepare an electrodeposition varnish having 13% of total nonvolatile matter which was uniformly dispersed.

A glass fiber tape having 0.1 mm of a thickness and 19 mm of a width was counded around an armature coil for rotary machine under partially overlapping.

Six of the wounded armature coils were bundled and wounded by the glass fiber tape under partially overlapping.

The bundled product as an anode and a stainless steel plate as a cathode were dipped into the electrodeposition varnish with 15 cm of the gap and 70 volts of DC voltage was applied for 60 seconds to electrodeposite the mica layer on the glass fiber tape by electrophoresis.

The electrodeposited product was taken out from the electrodeposition varnish and was heated at 230° C for 20 minutes and then was dipped into a polyamideimide resin varnish (HI-400 manufactured by Hitachi Kasei K. K.).

The product was taken out and heated to form an electrodeposited insulation film having 1 mm of an uniform thickness. The withstand voltage of the electrodeposited insulation film between the coils was 10 KV and the withstand voltage to the earth was higher than 45 KV.

EXAMPLE 8

A mica powder which was passed through 48 mesh sieve and was washed with water, was admixed with the water dispersion varnish of Example 6 at a ratio of 9 parts of the mica powder to 1 part of the resin component and the mixture was diluted with a pure water with stirring to prepare an electrodeposition varnish having 16% of total nonvolatile matter, which was uniformly dispersed.

A glass fiber tape having 0.13 mm of a thickness and 25 mm of a width was wounded around an armature coil for rotary machine under partially overlapping. Four of the wounded armature coils were bundled and wounded by the glass fiber tape under partially overlapping.

The bundled product as an anode and a stainless steel plate as a cathode were dipped into the electrodeposition varnish with 15 cm of the gap and 100 volts of DC voltage was applied for 90 seconds to electrodeposite the mica layer on the glass fiber tape by electrophoresis.

The electrodeposited product was taken out from the electrodeposition varnish and was heated at 230° C for 20 minutes, and then was dipped into a polyimide resin varnish (Norimide 102 varnish manufactured by Nippon Rhodia K. K.).

The product was taken out and heated to form an electrodeposited insulation film having 3 mm of an uniform thickness.

The withstand voltage of the electrodeposited insulation film between the coils was 10 KV and the withstand voltage to the earth was higher than 70 KV.

EXAMPLE 9

A mica powder which was passed through 100 mesh sieve and washed with water was admixed with a water dispersion acryl resin varnish (Lecton RK-6308 manufactured by E. I. DuPont) at a ratio of 9 parts of the mica powder to 1 part of the resin component and the mixture was stirred to prepare an uniformly dispersed electrodeposition varnish having 30% of nonvolatile matter.

A polyester nonwoven fabric tape having 0.05 mm of a thickness and 19 mm of a width was wounded around an armature coil for rotary machine under partially overlapping.

Six of the wounded armature coils were bundled and wounded by the polyester nonwoven fabric tape under partially overlapping.

The bundled product as an anode and a stainles steel plate as a cathode were dipped into the electrodeposition varnish with 15 cm of a gap and 150 volts of DC voltage was applied for 50 seconds to electrodeposite the mica layer on the polyester nonwoven fabric tape by electrophoresis. The electrodeposited product was taken out from the electrodeposition varnish and was heated at 230° C for 20 minutes and then was dipped into an epoxy resin (V-590-15 varnish manufactured by Ryoden Kasei K. K.) and was taken out and heated to form an electrodeposited insulation film having 2 mm of an uniform thickness.

The withstand voltage of the electrodeposited insulation film between the coils was 7 KV and the withstand voltage to the earth was higher than 65 KV.

When the other water dispersion varnishes such as polyurethane resin varnish, polyester resin varnish and polyimide resin varnish were used instead of the insulation varnish in said Examples 6 to 9, the similar characteristics were given.

What is claimed as new and intended to be covered by Letters Patent is:

1. A process for preparing an insulative product which comprises: immersing a substrate in an electrodeposition varnish prepared by mixing an inorganic powder having a particle size smaller than 20 mesh with a water dispersion varnish; electrodepositing the inorganic powder from said electrodeposition varnish to form an electrodeposited layer of high inorganic powder content on said substrate; and immersing said varnished substrate in an organic or an inorganic insulation varnish to impregnate the spaces of the electrodeposited layer with said insulation varnish.

2. The process of claim 1, wherein said electrodeposited layer having high inorganic powder content is formed on coils by electrophoresis, the products are heated, a plurality of the coils are bundled, and thereafter said electrodeposited layer is formed on said bundled coils, is heated and said organic or inorganic insulation varnish is impregnated into the spaces of the electrodeposited layer.

3. The process of claim 1, wherein said electrodeposited layer having high inorganic powder content is formed on an organic or inorganic fibrous material covering the substrate and the organic or inorganic insulation varnish is impregnated into the spaces of the electrodeposited layer.

4. The process of claim 1, wherein coils are covered with an organic or inorganic fibrous material, a plurality of said coils are bundled and covered with an organic or inorganic fibrous material, said electrodeposited layer having high inorganic powder content is formed on the fibrous material covering the bundled coils and said organic or inorganic insulation varnish is impregnated into the spaces of the electrodeposition layer.

5. The process of claim 1, wherein the inorganic powder is mica powder.

6. The process of claim 1, wherein the inorganic powder is a mixture of mica powder and another inorganic powder.

7. The process of claim 1, wherein the electrodeposition varnish contains mica powder or a mixture of mica powder and other inorganic powder, and a water dispersion varnish selected from the group consisting of polyurethane resin, polyester resin, epoxy resin, epoxyester resin, polyimide resin, polyamideimide resin, polyesterimide resin, and acryl resin varnishes at a ratio of 75 to 98 wt% of said mica powder or said mixture of mica powder, and 25–2 wt% of said resin varnish.

8. The process of claim 1, wherein the organic insulation varnish is epoxy resin, polyamideimide resin, silicone resin or polyimide resin.

* * * * *